US011312591B2

(12) United States Patent
Lin

(10) Patent No.: US 11,312,591 B2
(45) Date of Patent: Apr. 26, 2022

(54) PRINTER HAVING FRONT-END PAPER FEEDING AND FRONT-END PAPER OUTPUTTING AND BEING CAPABLE OF CHANGING PAPER DISCHARGE PATH

(71) Applicant: Yi Lin, Nanjing (CN)

(72) Inventor: Yi Lin, Nanjing (CN)

(73) Assignee: Yi Lin, Nanjing (CN)

( * ) Notice: Subject to any disclaimer, the term of this patent is extended or adjusted under 35 U.S.C. 154(b) by 17 days.

(21) Appl. No.: 16/481,830

(22) PCT Filed: Sep. 11, 2018

(86) PCT No.: PCT/CN2018/104950
§ 371 (c)(1),
(2) Date: Jul. 30, 2019

(87) PCT Pub. No.: WO2019/085647
PCT Pub. Date: May 9, 2019

(65) Prior Publication Data

US 2020/0062528 A1 Feb. 27, 2020

(30) Foreign Application Priority Data

Jun. 20, 2018 (CN) ..... 201810639488.0

(51) Int. Cl.
*B65H 29/60* (2006.01)
*B65H 29/58* (2006.01)
(Continued)

(52) U.S. Cl.
CPC ..... *B65H 29/60* (2013.01); *B65H 29/20* (2013.01); *B65H 29/52* (2013.01); *B65H 2701/1131* (2013.01); *B65H 2801/03* (2013.01)

(58) Field of Classification Search
CPC ..... B65H 29/58; B65H 29/60; B65H 29/22; B65H 31/24; B65H 2404/63;
(Continued)

(56) References Cited

U.S. PATENT DOCUMENTS 5,031,893 A * 7/1991 Yoneda ..... B41J 13/0045 271/65
6,817,699 B2 * 11/2004 Hirashima ..... B41J 2/1752 347/49
(Continued)

FOREIGN PATENT DOCUMENTS

CN 103042829 A 4/2013
CN 105051127 11/2015
(Continued)

*Primary Examiner* — Luis A Gonzalez
(74) *Attorney, Agent, or Firm* — Treasure IP Group, LLC

(57) ABSTRACT

A printer having front-end paper feeding and front-end paper outputting and being capable of changing a paper discharge path, said printer comprising a housing (10) and a paper discharge unit (40), the paper discharge unit (40) comprising a first paper discharge mechanism (401) and a paper discharge channel (50) which consists of upper and lower casings (1011, 1012), a front end surface of the housing (10) being a vertical flat surface A, a paper feed port (30) and a paper output port (20) being horizontally arranged on the flat surface A, the paper feed port (30) being located beneath the paper output port (20), the paper discharge channel (50) at the front of the first paper discharge mechanism (401) being provided with a paper conveyance system capable of changing a paper discharge path.

9 Claims, 4 Drawing Sheets

(51) Int. Cl.
*B65H 29/20* (2006.01)
*B65H 29/52* (2006.01)

(58) Field of Classification Search
CPC ..... B65H 2404/632; B65H 2511/11; B65H 29/125; B65H 2404/6112; B65H 2404/74; B65H 2404/741; B65H 29/52; B65H 29/20; B65H 2701/1131; B65H 2801/03; B41J 13/009; B41J 13/106; B41J 13/0054; B41J 29/023
See application file for complete search history.

(56) References Cited

U.S. PATENT DOCUMENTS

| | | | | |
|---|---|---|---|---|
| 7,905,480 | B2 * | 3/2011 | Ito | B65H 31/24 271/189 |
| 2015/0284202 | A1 * | 10/2015 | Asano | B65H 29/125 271/3.19 |
| 2017/0151799 | A1 * | 6/2017 | Yamaguchi | B41J 29/02 |
| 2017/0251120 | A1 * | 8/2017 | Nakashima | H04N 1/00748 |

FOREIGN PATENT DOCUMENTS

| | | | | |
|---|---|---|---|---|
| CN | 206872083 | U | | 1/2018 |
| JP | 63022438 | A | * | 1/1988 |
| JP | 11130301 | A | * | 5/1999 |
| JP | 11278745 | A | * | 10/1999 |
| JP | 2001042578 | A | * | 2/2001 |
| JP | 2005239361 | A | * | 9/2005 |
| JP | 2005324559 | | | 11/2005 |

* cited by examiner

PRINTER HAVING FRONT-END PAPER FEEDING AND FRONT-END PAPER OUTPUTTING AND BEING CAPABLE OF CHANGING PAPER DISCHARGE PATH

CROSS REFERENCE TO RELATED APPLICATION

This application claims priority to a PCT application PCT/CN2018/104950, filed on Sep. 11, 2018, which in turn takes priority of Chinese Application No. 201810639488.0, filed on Jun. 20, 2018. Both the PCT application and Chinese Application are incorporated herein by reference in their entireties.

TECHNICAL FIELD

The invention relates to printing equipment and particularly to a paper discharge path switchable front-end paper feeding and front-end paper discharging printer.

BACKGROUND OF THE INVENTION

Laser printers are applied more and more widely due to the relatively high printing definition and printing speed thereof. Existing laser printers generally adopt a front-end paper feeding and upper-end paper discharging or front-end paper feeding and rear-end paper discharging printing structure, but when an existing laser printer, serving as an output device, is configured together with an input device, a host, a display, and a touch screen to be used, for example, as an all-in-one machine in places such as a hospital, a public service mechanism, or a bank, the structure of existing printers is extremely inconvenient. In one all-in-one machine 100 as shown in FIG. 1, the printer 120 is configured as an output device and is arranged in a sealed case 110, together with other devices, a printing paper outlet 1101 is arranged at the front side of the case, and a paper receiving plate 130 is arranged close to the outlet 1101. As paper is discharged at the upper end of the existing laser printer and the paper outlet of the printer is relatively far away from the printing paper outlet 1101, a user cannot judge whether the printing is ended, whether the paper is discharged, whether there is a lack of paper, or whether the device has a fault. Therefore, it is of great significance to develop a front-end paper feeding and front-end paper discharging printer.

A front-end paper feeding and front-end paper discharging printer, disclosed by the Chinese patent CN206872083U, as shown in FIG. 2, comprises a printer shell 1; the printer shell is provided with a paper inlet 2 and a paper outlet 3; the paper inlet 2 and the paper outlet 3 are arranged in front of the shell 1; the paper inlet is internally provided with a big-capacity paper feeding box; a conveying and discharging system is arranged at the paper outlet; and the paper containing capacity of the big-capacity paper feeding box is 250 pages of 80 g A4 paper. The specific implementation scheme is that a conveying and discharging system is added at the 130 mm position of an original discharge mechanism of the machine; distance from the conveying and discharging system to the paper outlet in the front of the machine is 170 mm, so that the A4 paper when be discharged is guaranteed to go beyond the front face for more than 130 mm; and the A5 paper when being discharged is guaranteed to go beyond the front face for more than 20 mm. Although the scheme can solve the technical problem of the front-end paper feeding and front-end paper discharging of the laser printer, when the printer conducts printing on paper with different specifications such as A4 and A5, the distances that the front end faces of discharged paper sheets go beyond the front end face of the printer are different, the printer is not artistic in use and the A4 paper when being discharged is easy to fall off when going beyond the front face for more than 130 mm; furthermore, when the A5 paper is set to be discharged transversely, the A5 paper cannot be discharged from the paper outlet as the distance from the conveying and discharging system to the paper outlet in the front of the printer is 170 mm.

BRIEF SUMMARY OF THE INVENTION

In order to solve the technical problems of the distances that the front end faces of the discharged paper sheets go beyond the front end face of the printer are different when the existing front-end paper feeding and front-end paper discharging printer adopts A4 and A5 paper for printing, the paper is not artistic, and the A5 paper cannot be discharged from the paper outlet when the paper is discharged transversely, the invention provides a paper discharge path switchable front-end paper feeding and front-end paper discharging printer to guarantee that the front end faces of the paper sheets go an equal distance beyond the front end face of the printer during printing.

For this purpose, the technical scheme adopted by the invention is as follows:

a paper discharge path switchable front-end paper feeding and front-end paper discharging printer comprises a shell and a paper discharge unit; the paper discharge unit comprises a first paper discharge mechanism and a paper discharge channel composed of an upper shell body and a lower shell body; the front end face of the shell is a vertical plane A; a paper inlet and a paper outlet are horizontally formed in the plane A; the paper inlet is located under the paper outlet; and a paper discharge path switchable paper conveying system is arranged in the portion of the paper discharge channel in front of the first paper discharge mechanism.

Furthermore, the paper conveying system comprises a second paper discharge mechanism, a third paper discharge mechanism and a paper guide plate; the first paper discharge mechanism, the second paper discharge mechanism, and the third paper discharge mechanism are arranged in sequence; a paper discharge channel B, close to the paper outlet, is arranged between the third paper discharge mechanism and the shell; the first paper discharge mechanism, the second paper discharge mechanism and the paper discharge path B compose a first paper discharge path s1; the first paper discharge mechanism, the second paper discharge mechanism and the third paper discharge mechanism compose a second paper discharge path s2; and the paper guide plate is arranged between the third paper discharge mechanism and the second paper discharge mechanism and is used for converting the paper discharge paths.

Furthermore, the paper discharge channel B is arranged between the third paper discharge mechanism and the lower shell body; one end of the paper guide plate is rotationally fixed at the downside of the paper inlet of the third paper discharge mechanism through a rotating shaft and a paper guide plate drive motor fixedly connected with the rotating shaft while the other end thereof extends towards the third paper discharge mechanism and can swing up and down under the driving of the paper guide plate drive motor; when the other end swings to be close to the upside of the paper outlet of the second paper discharge mechanism, the printing paper is discharged through the first paper discharge path s1; and when the other end swings to the downside of the paper outlet of the second paper discharge mechanism, the printing paper is discharged through the second paper discharge path s2.

Furthermore, the paper discharge channel B is arranged between the third paper discharge mechanism and the upper shell body; one end of the paper guide plate is rotationally fixed at the upside of the paper inlet of the third paper discharge mechanism through the rotating shaft and the paper guide plate drive motor fixedly connected with the rotating shaft while the other end thereof extends towards the third paper discharge mechanism and can swing up and down under the driving of the paper guide plate drive motor; when the other end swings to be close to the downside of the paper outlet of the second paper discharge mechanism, the printing paper is discharged through the first paper discharge path s1; and when the other end swings to the upside of the paper outlet of the second paper discharge mechanism, the printing paper is discharged through the second paper discharge path s2.

Furthermore, the printer further comprises a control unit; the paper guide plate drive motor is electrically connected with the controller of the control unit. By connecting the operation of the paper guide plate drive motor with the controller, paper in different specifications can be identified automatically through the controller and consequently the printing paths can be converted automatically.

Furthermore, the paper guide plate is provided with a spiral spring; one end of the spiral spring is fixed while the other end is connected with the lower side face of the paper guide plate; the joint of the spiral spring and the paper guide plate is located at the middle part of the paper guide plate; and the spiral spring is used for supporting the paper guide plate. The position of the paper guide plate can be stabilized under the support of the spring force, and the positioning of the paper guide plate can be limited as the rotation of the motor can be limited by setting the load of the paper guide plate drive motor to be within a spring force range.

Furthermore, the second paper discharge mechanism comprises a second paper discharge roller, a second driven roller in friction transmission connection with the second paper discharge roller and a second driven roller bracket used for supporting the second driven roller; the third paper discharge mechanism comprises a third paper discharge roller, a third driven roller in friction transmission connection with the third paper discharge roller, and a third driven roller bracket used for supporting the third driven roller; the first, second, and third paper discharge rollers have equal roller surface linear velocity and are in transmission connection through gears or belts; the third paper discharge mechanism further comprises a paper discharge plate; and one end of the paper discharge plate is fixed at the third driven roller bracket while the other end extends along the paper discharge direction. As the original power system of the printer is utilized and only the gear or belt transmission is added to drive the rotation of the second and third paper discharge rollers, the printer is simple in structure, convenient to control and reliable in operation. When the paper discharge channel B is arranged between the third paper discharge mechanism and the lower shell body, the printing paper is supported by the paper discharge plate arranged at the third paper discharge mechanism.

Furthermore, the second paper discharge mechanism comprises a second paper discharge roller, a second driven roller in friction transmission connection with the second paper discharge roller, and a second driven roller bracket used for supporting the second driven roller; the third paper discharge mechanism comprises a third paper discharge roller, a third driven roller in friction transmission connection with the third paper discharge roller, and a third driven roller bracket used for supporting the third driven roller; the first, second, and third paper discharge rollers have equal roller surface linear velocity and are in transmission connection through gears or belts; the second paper discharge mechanism further comprises a paper discharge plate; and one end of the paper discharge plate is fixed at the second driven roller bracket while the other end extends along the paper discharge direction. As the original power system of the printer is utilized and only the gear or belt transmission is added to drive rotation of the second and third paper discharge rollers, the printer is simple in structure, convenient to control and reliable in operation. When the paper discharge channel B is arranged between the third paper discharge mechanism and the upper shell body, the printing paper is supported by the paper discharge plate arranged at the second paper discharge mechanism.

Furthermore, the distance between the second paper discharge mechanism and the paper outlet is 200 to 250 mm, and the distance between the third paper discharge mechanism and the paper outlet is 50 to 100 mm. When the printer is used for paper with the specifications of A4 and A5, the A4 paper is fed and discharged vertically and the A5 paper is discharged and fed transversely, the distances between the paper discharging front ends of A4 or A5 paper and the paper outlet are equal and are within 50-100 mm, and the paper sheets are neat, artistic, and convenient to take. The distance between the paper discharging front end and the paper outlet is too big to be contacted easily by persons to make the printing paper fall off or torn off and is too small to be taken conveniently by a user.

Furthermore, an upper cover which can be opened and closed is arranged at the upper shell body of the paper discharge unit, and paper clamped in the paper discharge channel can be taken out by opening the upper cover. As the clamped paper is taken by opening the upper cover, the printer is convenient to use and the integrated design of the printer is artistic.

The invention has the beneficial effects below: in comparison with the prior art, as the front end face of the shell of the printer is a vertical plane and the paper inlet and the paper outlet are located at the front end face, the printer is very convenient for paper feeding and discharging when the printer is configured as an all-in-one machine for use; and the paper outlet is close to the front side cover of the all-in-one machine, and the paper can be discharged smoothly. As the path switchable paper conveying system is arranged in the paper discharge channel in front of the first paper discharge mechanism, when the printer conducts printing on paper with different specifications such as A4 and A5 at the time of vertical feeding and discharging of A4 paper and transverse feeding and discharging of A5 paper, the distances that the front end faces of the discharged paper sheets go beyond the front end face of the printer can be made to be equal, and the paper sheets are neat, artistic, and convenient to take.

DETAILED DESCRIPTION OF THE INVENTION

In order to make the purpose, the technical scheme, and the advantages of the invention more clear, the technical scheme of the invention is described clearly and completely in combination with accompanying drawings and an implementation mode applicable to A4 paper and A5 paper.

Figure 1:
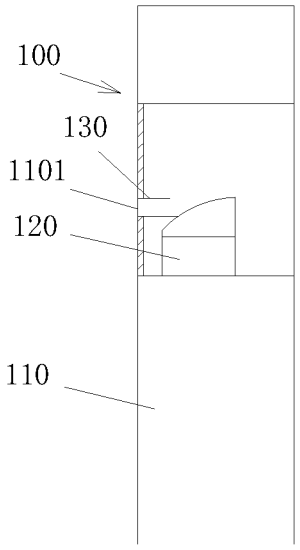
Fig.1 Prior Art
FIG. 1 is a schematic diagram of an existing laser printer when being configured as an all-in-one machine of the invention.
Figure 2:
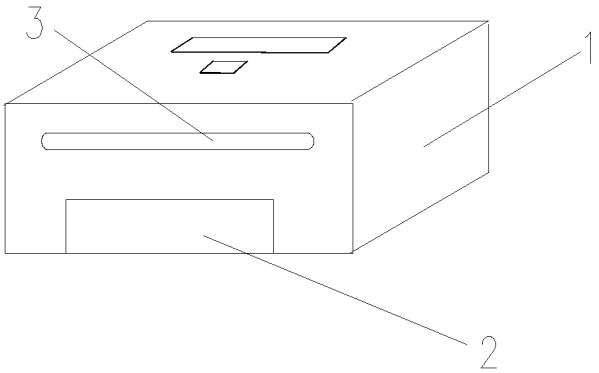
FIG. 2 is a schematic diagram of the whole structure of the existing front-end paper feeding and front-end paper discharging printer of the invention.

In the description below, the printing paper is discharged from the front side of the printer by regarding the orientation of the printer shown in FIG. 2 as a reference, and on the contrary, the printing paper is discharged from the backside.

Embodiment 1

Figure 3:
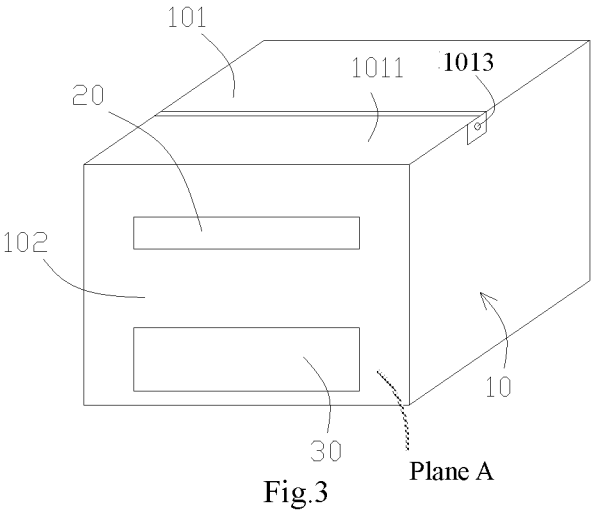
FIG. 3 is a schematic diagram of the whole structure of one embodiment of the printer of the invention.

See FIG. 3, a printer comprises a shell 10, the front end face 102 of the shell is a vertical plane A, a paper inlet 30 and a paper outlet 20 are horizontally formed in the plane A, and the paper inlet 30 is located under the paper outlet 20. An upper cover 1011 which can be opened and closed is arranged at the upper side face 101 of the shell 10; the upper cover 1011 is rotationally arranged at the two side faces of the shell 10 through a rotating shaft 1013; and paper clamped in the paper discharge channel can be taken out by opening the upper cover 1011.

Figure 4:
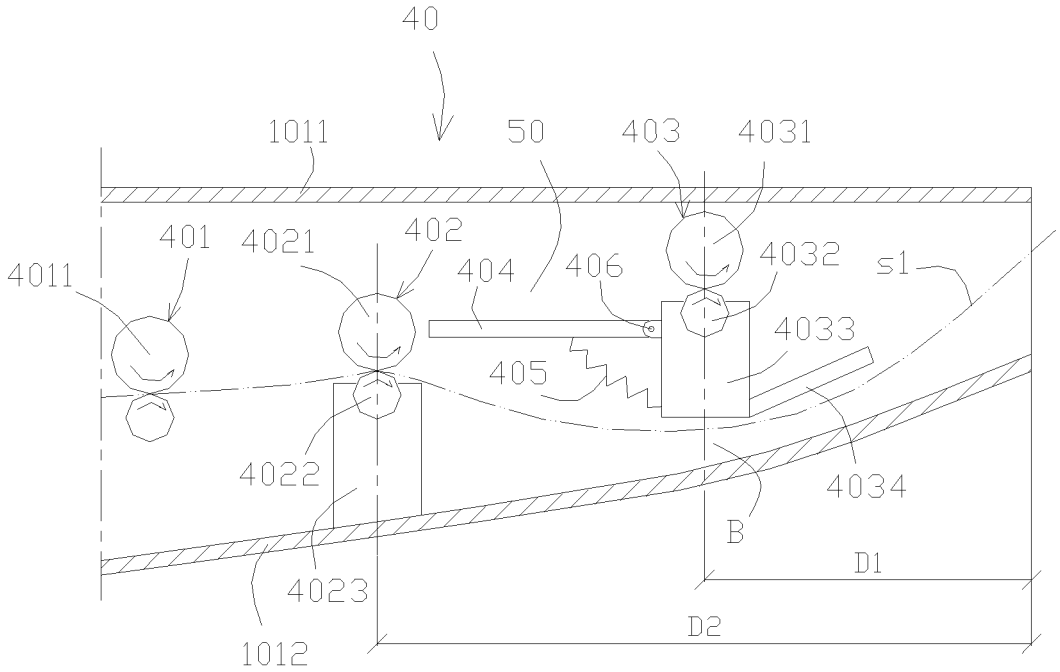
FIG. 4 is a structural schematic diagram of a first paper discharge path of the printer from embodiment 1 of the invention.
Figure 5:
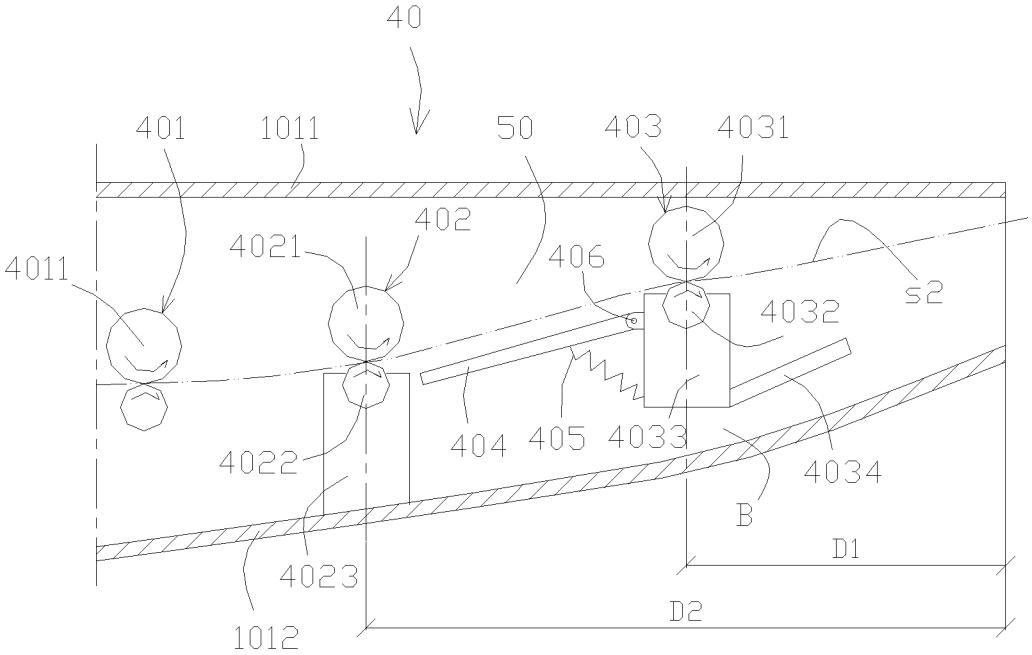
FIG. 5 is a structural schematic diagram of a second paper discharge path of the printer from embodiment 1 of the invention.

See FIG. 4 and FIG. 5, the printer further comprises a paper discharge unit 40; the paper discharge unit 40 comprises a first paper discharge mechanism 401, a paper conveying system and a paper discharge channel 50. The paper discharge channel 50 is composed of a movable upper cover 1011 and a lower shell body 1012.

The paper conveying system comprises a second paper discharge mechanism 402, a third paper discharge mechanism 403 and a paper guide plate 404. The second paper discharge mechanism 402 and the third paper discharge mechanism 403 are arranged in front of the first paper discharge mechanism 401 in sequence. An A4 paper discharge channel B is arranged between the third paper discharge mechanism 403 and the lower shell body 1012.

The second paper discharge mechanism 402 comprises a second paper discharge roller 4021, a second driven roller 4022, and a second driven roller bracket 4023. The second paper discharge roller 4021 is a drive roller and is arranged on the shell 10 through the rotating shaft; a second drive gear (not shown in the Fig.) is arranged at one end of the rotating shaft in a sleeved manner; the second drive gear is in drive connection with the drive roller gear (not shown in the Fig.) of the first paper discharge mechanism 401 through a first middle transition gear (not shown in the Fig.) arranged between the first paper discharge roller 4011 and the second paper discharge roller 4021; the second driven roller 4022 is rotationally arranged at the second driven roller bracket 4023 and is in friction drive connection with the second paper discharge roller 4021; and the second driven roller bracket 4023 is fixed at the bottom surface of the shell 10. The roller surface diameter and the linear velocity of the second paper discharge roller 4021 are same as the roller surface diameter and the linear velocity of the first paper discharge roller 4011.

In another embodiment, the second paper discharge roller 4021 can also be in drive connection with the drive roller of the first paper discharge mechanism 401 through a belt.

The third paper discharge mechanism 403 comprises a third paper discharge roller 4031, a third driven roller 4032, a third driven roller bracket 4033 and a paper discharge plate 4034. The third paper discharge roller 4031 is a drive roller and is arranged at the shell 10 through the rotating shaft; a third drive gear (not shown in the Fig.) is arranged at one end of the rotating shaft in a sleeved manner; the third drive gear is in drive connection with the second drive gear (not shown in the Fig.) through a second middle transition gear (not shown in the Fig.) arranged between the second paper discharge roller 4021 and the third paper discharge roller 4031; the third driven roller 4032 is rotationally arranged at the third driven roller bracket 4033 and is in friction drive connection with the third paper discharge roller 4031; the third driven roller bracket 4033 is fixed at the side face of the shell 10; and an A4 paper discharge channel B is arranged at the bottom surface 1012 of the shell. One end of the paper discharge plate 4034 is fixedly at the front side face of the third driven roller bracket 4033 while the other end extends along the paper discharge direction. The roller surface diameter and the linear velocity of the third paper discharge roller 4031 are same as the roller surface diameter and the linear velocity of the second paper discharge roller 4021.

In other embodiments, the third paper discharge roller 4031 can also be in drive connection with the drive roller of the second paper discharge mechanism through the belt.

Figure 6:
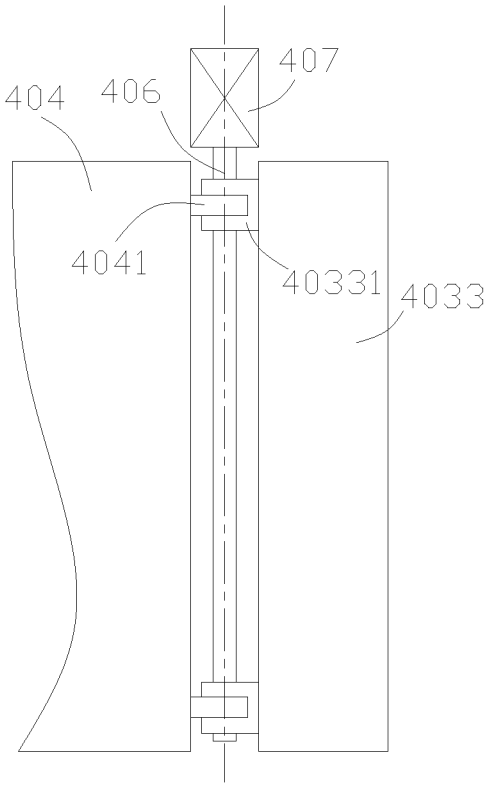
FIG. 6 is a schematic diagram of a connection structure of a paper guide plate and the third driven roller bracket of the printer from embodiment 1 of the invention.

In the embodiment, the paper guide plate 404 is arranged between the third paper discharge mechanism 403 and the second paper discharge mechanism 402; one end of the paper guide plate 404 is arranged at the third driven roller bracket 4033 through the rotating shaft 406; and one end of the rotating shaft is connected with a paper guide plate drive motor 407, see FIG. 6. A spiral spring 405 is arranged at the middle of the paper guide plate 404; one end of the spiral spring 405 is fixedly connected with the back side face of the third driven roller bracket 4033 while the other end thereof is connected with the lower side face of the paper guide plate 404. When the paper guide plate 404 is rotated downwards, the spiral spring 405 is compressed; and when the paper guide plate 404 is rotated upwards, the spiral spring 405 extends.

Figure 7:
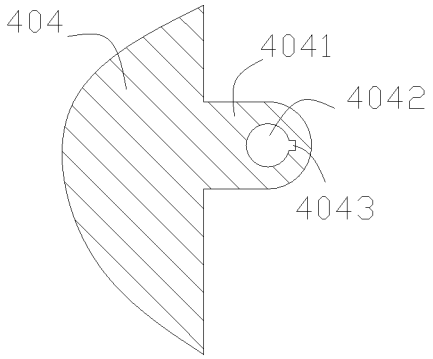
FIG. 7 is a structural schematic diagram of the connecting part of the paper guide plate in FIG. 6.
Figure 8:
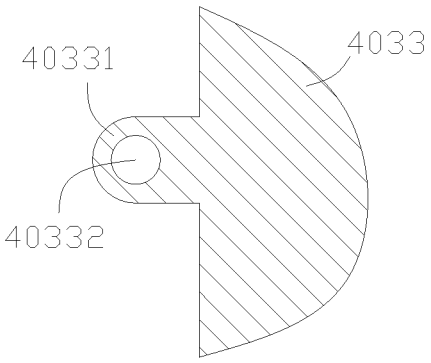
FIG. 8 is a structural schematic diagram of the connecting part of the third driven roller bracket in FIG. 6.

See FIG. 6-8, in the embodiment, the connection mode of the paper guide plate 404 and the third driven roller bracket 4033 is as follows: bumps 4041 are arranged at the two ends of the front side face of the paper guide plate 404. As shown in FIG. 7, the bumps 4041 are provided with first through holes 4041 along the thickness direction, and the inner wall of each through hole 4042 is provided with an axial through key slot 4043. U-shaped bumps 40331 are arranged at the two ends of the front side face of the third driven roller bracket 4033; spacing greater than the thickness of each bump 4041 is arranged between the two convex parts of the U-shaped bumps 40331, as shown in FIG. 8, a second through hole 40332 is formed in each U-shaped bump 40331 in a through manner along the thickness direction. The two bumps 4041 of the paper guide plate are respectively clamped between the two convex parts of the U-shaped bumps 40331 of the third driven roller bracket. The paper guide plate drive motor 407 is fixed at the shell 10; the rotating shaft 406 penetrates the second through holes 40332 and the first through holes 4042 and is arranged at the shell 10; the rotating shaft 406 is in friction drive connection with the second through hole 40332 and is fixedly connected with the first through hole 4042 through the flat keys arranged in the key slots 4043. The paper guide plate drive motor 407 rotates to drive the paper guide plate 404 to swing up and down; when the paper guide plate 404 swings close to the downside of the paper outlet of the second paper discharge mechanism 402, as shown in FIG. 5, the A5 printing paper is discharged sequentially by the first paper discharge mechanism 401, the second paper discharge mechanism 402 and the third paper discharge mechanism 403; s2 is the paper discharge path, and the spiral spring 405 at the moment is in a compressed state; when the paper guide plate 404 rotates to the upside of the paper outlet of the second paper discharge mechanism 402, as shown in FIG. 4, the A4 printing paper is discharged by sequentially passing through the first paper discharge mechanism 401, the second paper discharge mechanism 402 and the paper discharge channel B; s1 is the paper discharge path, and the spiral spring 405 is in an extended state at the moment.

In the embodiment, the distance D2 between the second paper discharge mechanism 402 and the paper outlet is 235 mm; mechanism 402 and the paper outlet is 235 mm; the distance between the third paper discharge mechanism 403 and the paper outlet is 85 mm; when the printing paper is A4 paper, the A4 paper is fed and discharged vertically, the printing path S1 is selected; after the A4 is discharged by the second paper discharge mechanism 402, the tail end of the A4 paper falls at the front side face of the second driven roller bracket 4022 and the rear end face of the paper is flushed with the front side face of the second driven roller bracket, that is, providing that the distance between the front side face of the second driven roller bracket 4023 and the central line is 10 mm and the length of the A4 is 300 mm, the distance that the front end face of the A4 paper goes beyond the paper outlet of the printer is 75 mm; when the printing paper is A5 paper, the A5 paper is fed and discharged transversely; the printing path S2 is selected; after being discharged by the third paper discharge mechanism 403, the tail end of the A5 paper falls at the front side face of the third driven roller bracket 4033 and the paper discharge plate 4034; the rear end face of the A5 paper is flushed with the front side face of the third driven roller bracket 4033, that is, providing that the distance between the front side face of the third driven roller bracket 4033 and the central line is 10 mm and the width of the A5 is 150 mm, the distance that the front end face of the A5 paper goes beyond the paper outlet of the printer is 75 mm.

In another embodiment, the distance D2 between the second paper discharge mechanism 402 and the paper outlet can be selected within a range from 200 to 250 mm or within a wider range based on need of application places; and the distance D1 between the third paper discharge mechanism 403 and the paper outlet can be selected within a range from 50 to 100 mm or within a wider range until the need is met.

In the embodiment, when the paper guide plate drive motor 407 is electrically connected with the controller of the control unit and when the control system identifies that the selected printing paper is A4 paper, the control system automatically controls the paper guide plate drive motor 407 to drive the paper guide plate 404 to swing upwards to be higher than the paper outlet of the second paper discharge mechanism 402, and the A4 paper is discharged automatically from the S1 path; and when the control system identifies that the selected printing paper is A5 paper, the control system automatically controls the paper guide plate drive motor 407 to drive the paper guide plate 404 to swing downwards to be lower than the paper outlet of the second paper discharge mechanism 402, and the A5 paper supported by the paper guide plate 404 is discharged automatically from the S2 path.

Embodiment 2

Figure 9:
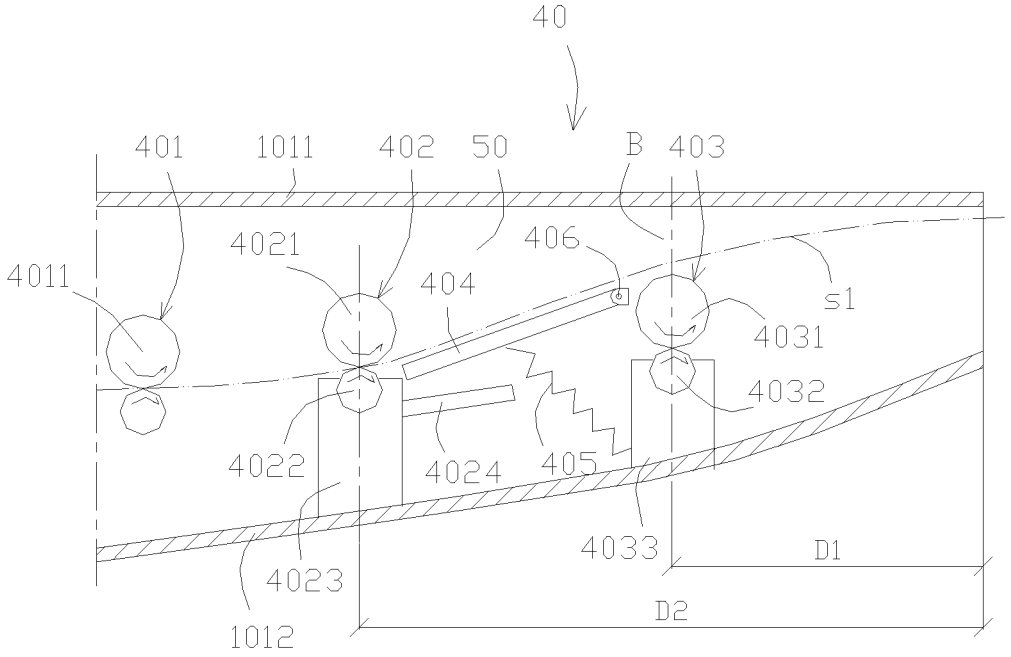
FIG. 9 is a structural schematic diagram of the first paper discharge path of the printer from embodiment 2.
Figure 10:
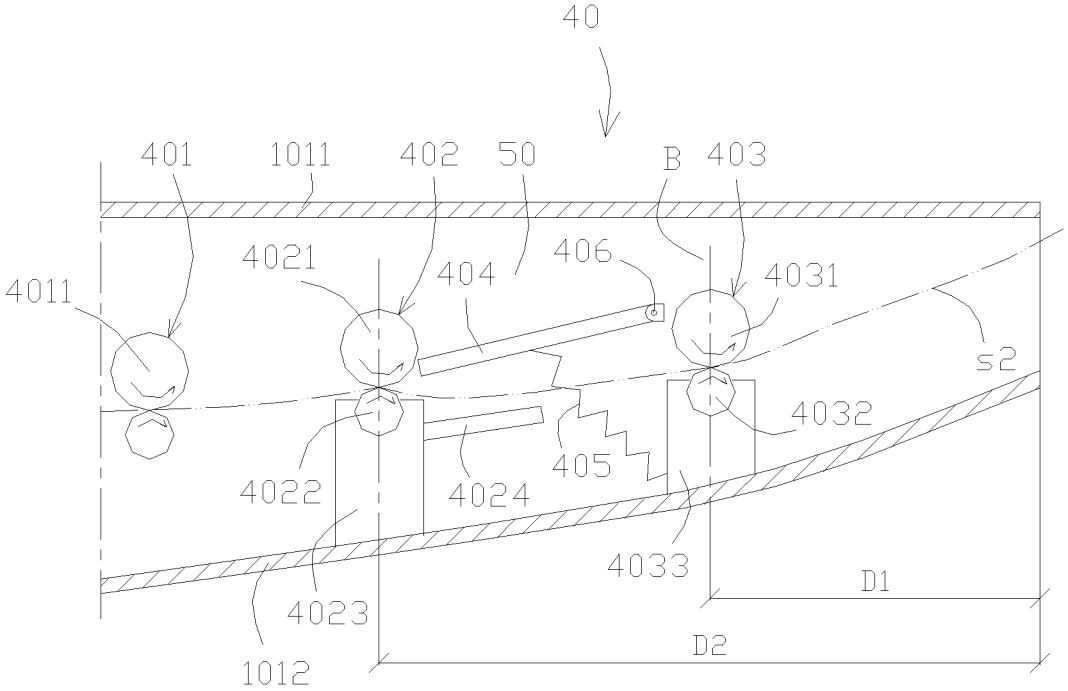
FIG. 10 is a structural schematic diagram of the second paper discharge path of the printer from embodiment 2.

See FIG. 9 and FIG. 10, the structure of the embodiment 2 is basically same as the embodiment 1. Same parts have the same mark numbers in FIG. 3 and FIG. 4. The difference is only in that the third driven roller bracket 4033 is fixed at the bottom surface of the shell 10, an A4 paper discharge channel B is arranged between the third paper discharge mechanism 403 and the top surface of the shell, that is, the upper cover 1011; a paper receiving plate 4024 is arranged at the upper end of the front side face of the second driven roller bracket 4023; the paper receiving plate 4024 is used for receiving the printing paper fallen off from the second paper discharge roller; and one end of the paper guide plate 404 is fixed at the two side faces of the shell 10.

In the embodiment 2, the paper guide plate drive motor 407 rotates to drive the paper guide plate 404 to swing up and down around the rotating shaft 406; when the paper guide plate swings to be close to the upside of the paper outlet of the second paper discharge mechanism 402, as shown in FIG. 10, the A5 printing paper is discharged sequentially by the first paper discharge mechanism 401, the second paper discharge mechanism 402 and the third paper discharge mechanism 403; the tail end of the paper falls at the front side face of the third driven roller bracket 4033; s2 is the paper discharge path; and the spiral spring 405 is in the extended state at the moment. When the paper guide plate swings to the downside of the paper outlet of the second paper discharge mechanism 402, as shown in FIG. 9, the A4 printing paper is discharged sequentially by the first paper discharge mechanism 401, the second paper discharge mechanism 402 and the paper discharge channel B; the tail end of the paper falls at the front side face of the second driven roller bracket 4023 and the paper receiving plate 4024; s1 is the paper discharge path; and the spiral spring 405 is in the compressed state at the moment.

All the parts not specified in the above instructions are existing technologies or can be achieved through existing technologies.

The invention claimed is:

1. A printer having front-end paper feeding and front-end paper outputting and being capable of changing paper discharge path, comprising a shell and a paper discharge unit, wherein the paper discharge unit comprises a first paper discharge mechanism and a paper discharge channel composed of an upper shell body and a lower shell body, across the first paper discharge mechanism and the printer is characterized in that a front end face of the shell is a vertical plane (A), a paper inlet and a paper outlet port are horizontally disposed on the vertical plane (A), said paper outlet port allowing paper to be discharged beyond front end face of the shell;

the paper inlet is located under the paper outlet port, and a paper conveying system is arranged in a portion of the paper discharge channel in front of the first paper discharge mechanism, wherein the paper conveying system comprises a second paper discharge mechanism, a third paper discharge mechanism and a paper guide plate;

the first paper discharge mechanism, the second paper discharge mechanism, and the third paper discharge mechanism are arranged in sequence;

a paper discharge channel B, adjacent to the paper outlet port, is arranged below the third paper discharge mechanism and above the lower shell body or above the third paper discharge mechanism and below the upper shell body;

the first paper discharge mechanism, the second paper discharge mechanism, and the paper discharge channel B form a first paper discharge path (s1);

the first paper discharge mechanism, the second paper discharge mechanism, and the third paper discharge mechanism form a second paper discharge path (s2);

and paper guide plate is arranged between the third paper discharge mechanism and the second paper discharge mechanism and is used for converting the paper discharge paths, wherein ends of the first paper discharge path (s1) and second paper discharge path (s2) extend to include the paper outlet port.

2. The printer of claim 1, characterized in that the paper discharge channel B is arranged between the third paper discharge mechanism and the lower shell body;

one end of the paper guide plate is rotationally fixed at a downside of the paper inlet of the third paper discharge mechanism through a rotating shaft and a paper guide plate drive motor fixedly connected with the rotating shaft while the other end thereof extends towards the second paper discharge mechanism and can swing up and down under the driving of the paper guide plate drive motor;

when the other end swings to be close to an upside of the paper outlet port of the second paper discharge mechanism, the printing paper is discharged through the first paper discharge path (s1); and when the other end swings to the downside of the paper outlet port of the second paper discharge mechanism, the printing paper is discharged through the second paper discharge path (s2).

3. The printer of claim 2, characterized by further comprising a control unit, wherein the paper guide plate drive motor is electrically connected with the controller of the control unit.

4. The printer of claim 2, characterized in that the paper guide plate is provided with a spiral spring;

one end of the spiral spring is fixed while the other end is connected with the lower side face of the paper guide plate;

the joint of the spiral spring and the paper guide plate is located at the middle part of the paper guide plate; and the spiral spring is used for supporting the paper guide plate.

5. The printer of claim 2, characterized in that the second paper discharge mechanism comprises a second paper discharge roller, a second driven roller in friction transmission connection with the second paper discharge roller and a second driven roller bracket used for supporting the second driven roller;

the third paper discharge mechanism comprises a third paper discharge roller, a third driven roller in friction transmission connection with the third paper discharge roller, and a third driven roller bracket used for supporting the third driven roller;

the first, second, and third paper discharge rollers have equal roller surface linear velocity and are in transmission connection through gears or belts; and the third paper discharge mechanism further comprises a paper discharge plate;

one end of the paper discharge plate is fixed at the third driven roller bracket while the other end extends along the paper discharge direction.

6. The printer of claim 2, characterized in that the distance between the second paper discharge mechanism and the paper outlet port is 200 to 250 mm, and the distance between the third paper discharge mechanism and the paper outlet port is 50 to 100 mm.

7. The printer of claim 2, characterized in that an upper cover which can be opened and closed is arranged at the upper shell body of the paper discharge unit, and paper clamped in the paper discharge channel can be taken out by opening the upper cover.

8. The printer of claim 1, characterized in that the paper discharge channel B is arranged between the third paper discharge mechanism and the upper shell body;

one end of the paper guide plate is rotationally fixed at an upside of the paper inlet of the third paper discharge mechanism through the rotating shaft and a paper guide plate drive motor fixedly connected with the rotating shaft while the other end thereof extends towards the second paper discharge mechanism and can swing up and down under the driving of the paper guide plate drive motor;

when the other end swings to be close to the downside of the paper outlet port of the second paper discharge mechanism, the printing paper is discharged through the first paper discharge path s1; and when the other end swings to the upside of the paper outlet port of the second paper discharge mechanism, the printing paper is discharged through the second paper discharge path (s2).

9. The printer of claim 8, characterized in that the second paper discharge mechanism comprises a second paper discharge roller, a second driven roller in friction transmission connection with the second paper discharge roller and a second driven roller bracket used for supporting the second driven roller;

the third paper discharge mechanism comprises a third paper discharge roller, a third driven roller in friction transmission connection with the third paper discharge roller, and a third driven roller bracket used for supporting the third driven roller;

the first, second and third paper discharge rollers have equal roller surface linear velocity and are in transmission connection through gears or belts;

and the second paper discharge mechanism further comprises a paper discharge plate;

one end of the paper discharge plate is fixed at the second driven roller bracket while the other end extends along the paper discharge direction.

* * * * *